United States Patent [19]

Jencks

[11] Patent Number: 4,838,043

[45] Date of Patent: Jun. 13, 1989

[54] CIRCULAR WARP KNIT COMPOSITE CORD

[75] Inventor: Davis C. Jencks, Seekonk, Mass.

[73] Assignee: New England Overseas Corporation, Inc., Providence, R.I.

[21] Appl. No.: 182,497

[22] Filed: Apr. 18, 1988

[51] Int. Cl.[4] ..... D04B 21/14; D04B 25/02

[52] U.S. Cl. ..... 66/170; 66/192

[58] Field of Search ..... 66/94, 80, 81, 170, 66/190, 192

[56] References Cited

U.S. PATENT DOCUMENTS

| | | | |
|---|---|---|---|
| 3,255,614 | 6/1966 | Kemmnitz | 66/192 |
| 3,738,125 | 6/1973 | Blezard et al. | 66/170 |
| 3,748,874 | 7/1973 | Blezard | 66/170 X |
| 3,808,840 | 5/1974 | Blezard et al. | 66/170 X |
| 3,842,628 | 10/1974 | Bennett et al. | 66/193 |
| 3,939,671 | 2/1976 | Lawson et al. | 66/86 R |
| 4,123,830 | 11/1978 | Matsuda et al. | 66/192 |
| 4,518,640 | 5/1985 | Wilkens | 66/192 X |

FOREIGN PATENT DOCUMENTS

| | | | |
|---|---|---|---|
| 261093 | 4/1968 | Austria | 66/192 |
| 0106132 | 4/1984 | European Pat. Off. . | |
| 0189173 | 7/1986 | European Pat. Off. . | |
| 2393879 | 2/1979 | France | 66/190 |
| 1081118 | 6/1977 | Italy . | |
| 184214 | 5/1981 | Italy . | |
| 825720 | 4/1981 | U.S.S.R. | 66/170 |
| 424686 | 2/1935 | United Kingdom | 66/190 |
| 1216830 | 12/1970 | United Kingdom | 66/192 |
| 2125075 | 2/1984 | United Kingdom | 66/192 |

*Primary Examiner*—Wm. Carter Reynolds

*Attorney, Agent, or Firm*—Bell, Seltzer, Park & Gibson

[57] ABSTRACT

The circular warp knit composite cord includes a circular warp knit tube with a plurality of wales of base yarn needle loops circumferentially spaced around the tube. The base yarns forming the wales of needle loops also form laps extending between and the interconnecting the circumferentially spaced wales of base yarn needle loops. Inlaid yarns are interlaced in selected ones of the wales of the base yarn needle loops and extend therealong to control longitudinal stretchability of the circular warp knit tube. If desired, a core element can be provided to extend longitudinally along the center of the circular warp knit tube. The knitting of the composite card is carried out on a circular warp knitting machine including circularly arranged and circumferentially spaced-apart needles supported for simultaneous longitudinal movement between an upper clearing level and a lower stitch loop forming level.

4 Claims, 3 Drawing Sheets

CIRCULAR WARP KNIT COMPOSITE CORD

FIELD OF THE INVENTION

This invention relates generally to circular warp knit composite cords or yarns, and more particularly to a circular warp knit composite cord including a circular warp knit tube formed by a plurality of circumferentially spaced wales of base yarn needle loops, and inlaid yarns interlaced in selected ones of the wales of base yarn needle loops and extending therealong to control longitudinal stretchability and other physical characteristics of the circular warp knit tube. If desired, longitudinally extending core yarns or elements may be provided in the center of the circular warp knit tube.

BACKGROUND OF THE INVENTION

It is generally known to inlay or interlace yarns in selected wales of various types of flat warp knit fabrics. Such inlaid yarns have been incorporated in flat warp knit fabrics for ornamental purposes, to provide stiffness, and to provide other characteristics to the fabric. It is also known to form a circular warp knit cord or yarn on a small diameter circular knitting machine by forming wales of needle loops of base yarns circumferentially spaced around a circular warp knit tube, and with or without a core. Such a circular warp knit cord is disclosed in U.S. Pat. No. 4,123,830 in which the circular warp knit tube surrounds a centrally extending core. However, the circular warp knit tube of this patent does not include inlaid yarns interlaced in selected ones of the wales of the base yarn needle loops so that the longitudinal stretchability of the circular warp knit tube is not stabilized. Therefore, the cord of this patent is not suitable for use in certain operations, such as knitting, weaving, wrapping or the like, or for use in other instances where characteristics such as longitudinal stretchability, strength, stiffness, conductivity, bulk and filtration properties must be imparted to the warp knit cord.

SUMMARY OF THE INVENTION

With the foregoing in mind, it is an object of the present invention to provide a circular warp knit composite cord , and wherein the circular warp knit composite cord includes a circular warp knit tube having a plurality of wales of base yarn needle loops circumferentially spaced around the tube with the base yarns forming the wales of needle loops also forming laps extending between and interconnecting the circumferentially spaced wales of base yarn needle loops, and inlaid yarns interlaced in selected ones of the wales of base yarn needle loops and extending longitudinally therealong to control longitudinal stretchability of the circular warp knit tube. The inlaid yarns interlaced in the wales of the circular warp knit tube also permit the imparting of certain other characteristics to the composite cord which are not obtainable if the inlaid yarns are not present. For example, other physical characteristics of the cord can be varied, depending upon the type of inlay yarns used, such as tensile strength, stability, bulk conductive properties and filtration and osmotic properties. If desired, a core yarn or element may extend along the center of the circular warp knit tube to provide additional characteristics to the warp knit composite cord.

The circular warp knit composite cord of the present invention provides a three-dimensional structure which retains its three-dimensional characteristics after being knit or woven into fabric form or after having been braided, served, twisted, wound or the like. The physical properties of the circular warp knit composite cord of the present invention are determined by the types of base yarns, inlaid yarns, and core yarns used, the stitch size, the number of needles in the cylinder, and the number, type and placement of the inlaid yarns interlaced in the wales of the base yarn needle loops. The types of yarns used in the circular warp knit composite cord of the present invention are selected to provide the desired physical characteristics to the composite cord.

The circular warp knit composite yarn of the present invention is knit on a circular warp knitting machine equipped most frequently with a relatively small needle cylinder containing from two to twelve circularly arranged and circumferentially spaced-apart needles. Certain end-products, however, require larger needle cylinders containing up to sixty or more needles. The needles are supported for simultaneous longitudinal up and down movement between an upper clearing or shed level and a lower stitch loop forming or drawing level. The circular warp knit composite cord is formed by feeding a base yarn to each of the needles each time the needles are moved to the raised clearing level so that base yarn needle loops are formed when the needles are moved to the lower stitch loop forming level.

The base yarns which form needle loops on selected needles in each course are circumferentially shifted to form needle loops on other needles in the next course and to form laps extending between and interconnecting the circumferentially spaced wales of base yarn needle loops. While the base yarns are being fed to the vertically reciprocating needles to form successive courses, inlay yarns are guided to opposite sides of at least selected ones of the needles as they move between the clearing level and the stitch loop forming level to thereby interlace the inlay yarns in selected ones of the wales of the base yarn needle loops.

The inlaid yarns of the present circular warp knit composite cord can include various types of yarn, depending upon the type of physical characteristics to be imparted to the circular warp knit composite cord. For example, glass, ceramic, "Teflon," carbon, "Kevlar," fiber optic, or electrically conductive metal yarns may be utilized.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
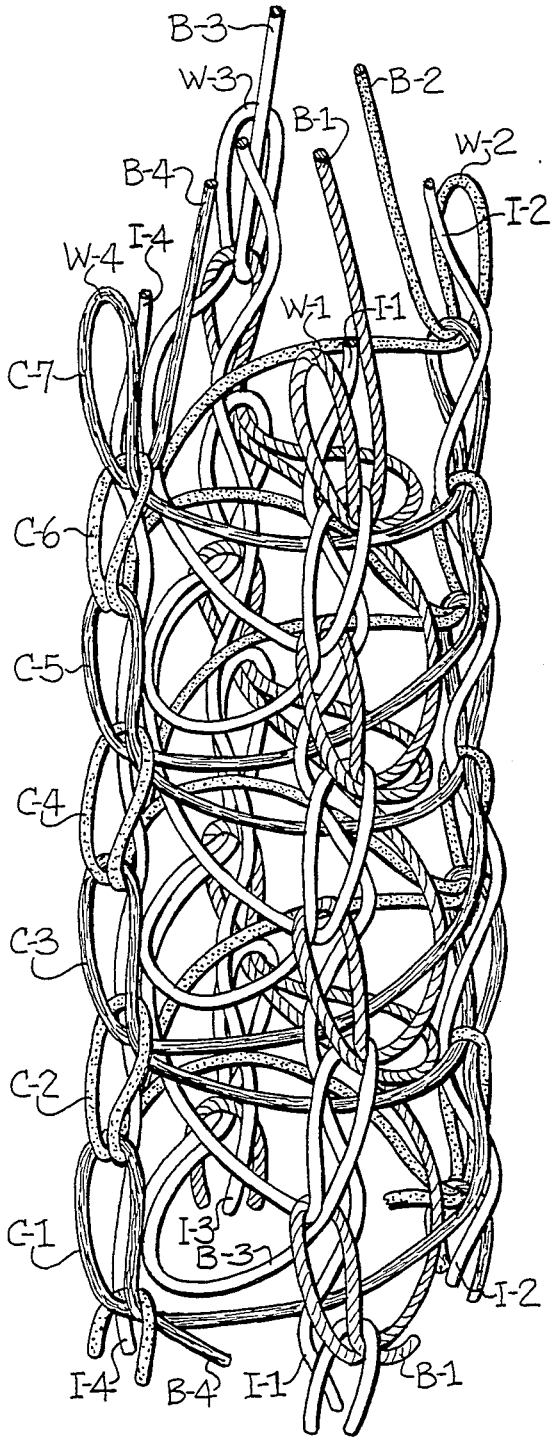
FIG. 1 is a greatly enlarged and somewhat schematic view showing the loop structure of the circular warp knit composite cord of the present invention.
Figure 2:
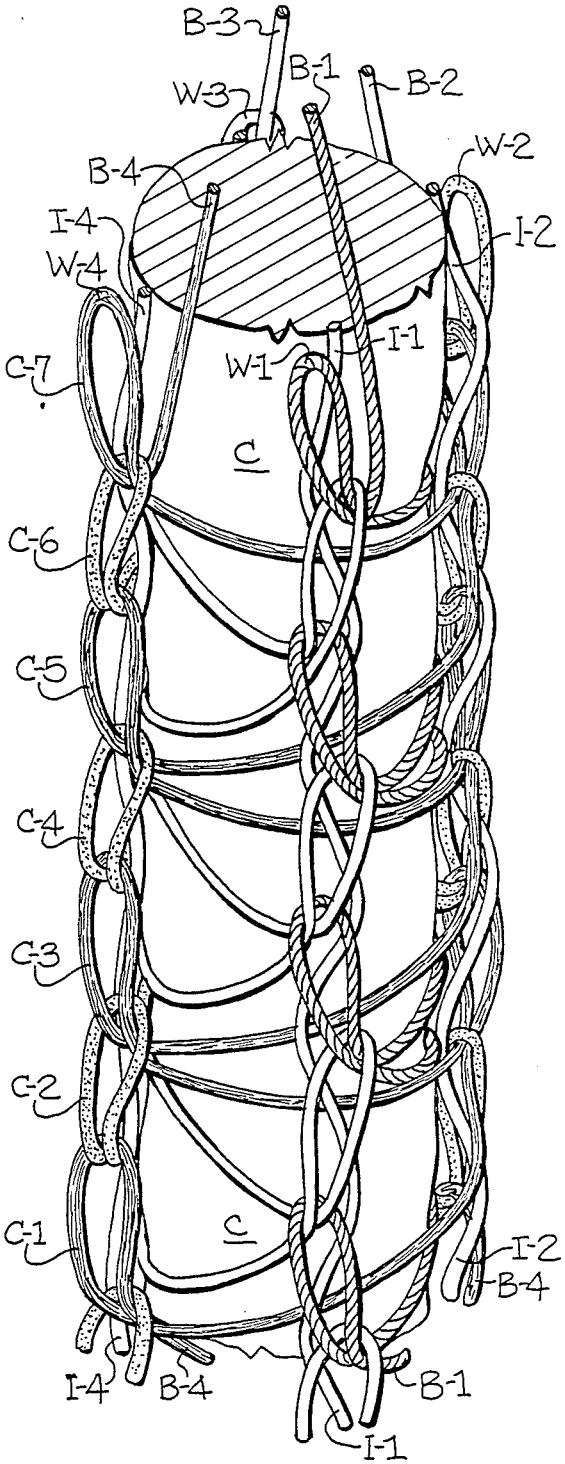
FIG. 2 is a view similar to FIG. 1 but further illustrating a core element extending along the central portion of the composite cord.

The circular warp knit composite cords illustrated in FIGS. 1 and 2 are knit on a circular warp knitting machine of the type illustrated in FIGS. 3–7, including four circularly arranged and circumferentially spaced-apart latch needles supported for simultaneous longitudinal movement, to be presently described. However, it is to be understood that the present circular warp knit composite cord may also be knit on a circular warp knitting machine of the type illustrated, including a greater or lesser number of needles.

As illustrated in FIG. 1, the present circular warp knit composite cord includes a circular warp knit tube having four wales, indicated at W-1 through W-4, of base or body yarn needle loops circumferentially spaced around the tube. The base yarn needle loops form successive courses illustrated at C-1 through C-7. Separate and individual base yarns, indicated at B-1 through B-4, each form base yarn needle loops in corresponding wales W-1 through W-4 of course C-1 and form circular and diagonally extending laps extending between and interconnecting the circumferentially spaced wales of the course C-1 with opposite needle loops positioned in the opposite wales in the next successive course C-2. Shading has been added to the base yarns in FIGS. 1 and 2 to help distinguish one base yarn from the other. Corresponding inlaid yarns, indicated at, I-1 through I-4 are illustrated as being interlaced with the base yarn needle loops in corresponding with W-1 through W-4.

The inlaid yarns I-1 through I-4 extend in a generally zigzag path along the corresponding wales W-1 through W-4 and control the longitudinal stretchability of the circular warp knit tube. The inlaid yarns I-1 through I-4 can also be used to impart other types of physical characteristics to the composite cord. Laps of the base yarns extend from certain needle loops in one course to opposite needle loops in the next successive course. The laps are illustrated as following a circular path in FIG. 1 in order to more clearly illustrate the loop configuration. In actual practice, the wales W-1 through W-4 of base yarn needle loops are drawn close together and the laps extend in substantially a straight-line path from a needle loop in one wale of a given course to an opposite needle loop in the next successive course of the circular warp knit tube.

The circular warp knit composite cord of FIG. 2 includes the same type of circular warp knit tube illustrated in FIG. 1 and further includes a core yarn or element C extending longitudinally and downwardly through the center of the circular warp knit tube. While inlaid yarns I-1 through I-4 are illustrated as being interlaced in each of the wales W-1 through W-4 of FIGS. 1 and 2, it is to be understood that the inlaid yarns can be interlaced in selected ones of the wales of the base yarn needle loops. For example, an inlaid yarn I-1 can be interlaced in only the wale W-1, or inlaid yarns I-1 and I-3 can be interlaced in the corresponding wales W-1 and W-3. In either instance, the inlaid yarns extend along the corresponding wales of base yarn needle loops and control the longitudinal stretchability of the circular warp knit tube.

Figure 3:
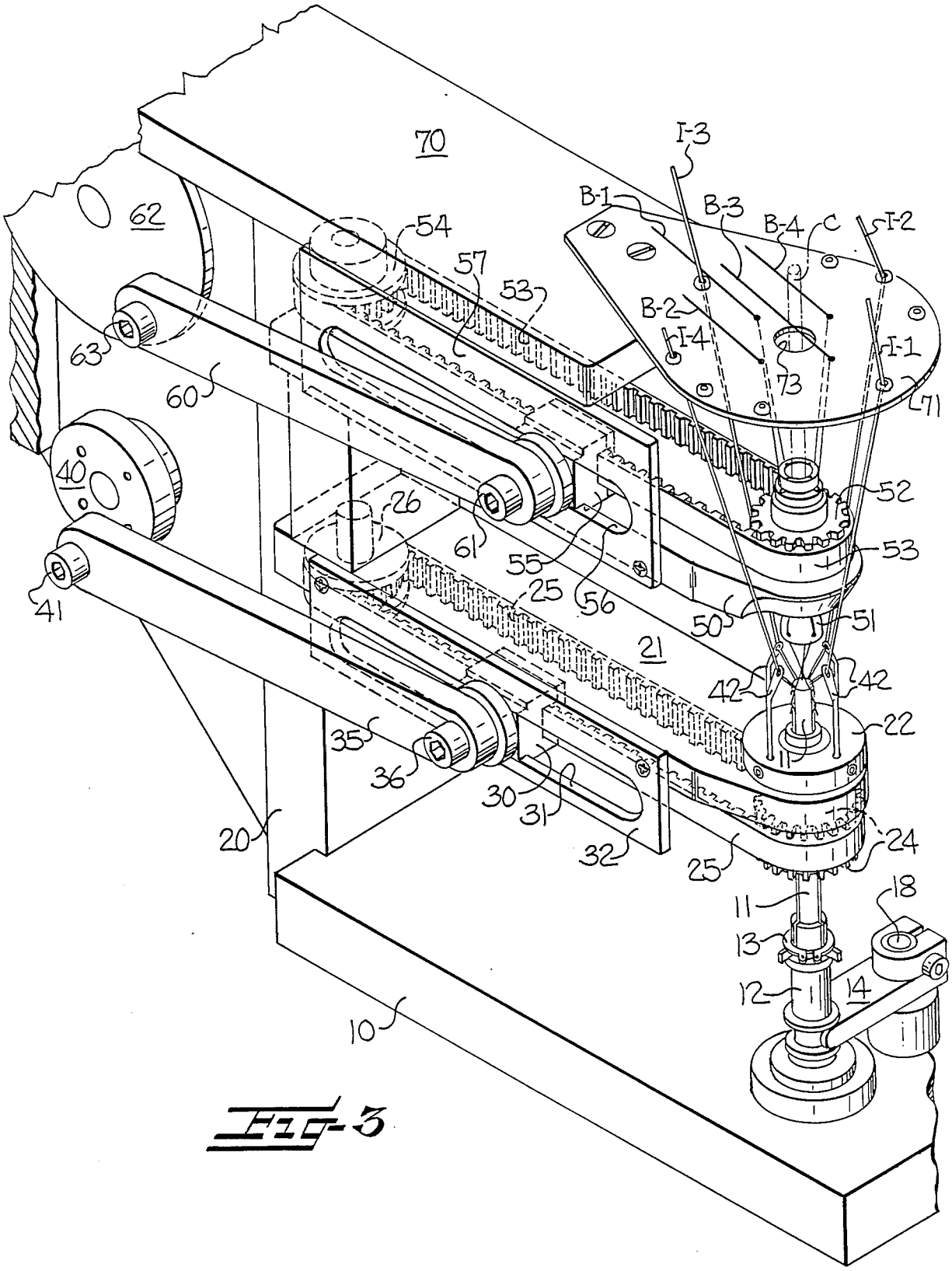
FIG. 3 is a fragmentary isometric view of a portion of a circular warp knitting machine of the type on which the circular warp knit composite cord of the present invention is knit.

The present circular warp knit composite cord is knit on a circular warp knitting machine, the main parts of which are illustrated in FIG. 3. The circular warp knitting machine includes a base frame member or plate 10 in the forward end portion of which is supported the lower end portion of a hollow and fixed needle cylinder 11. Latch needles N-1 through N-4 (FIG. 4) are circularly arranged and circumferentially spaced apart in longitudinal grooves or slots in the needle cylinder 11 for simultaneous longitudinal up and down movement by means of a vertically reciprocal sleeve 12 surrounding the lower end portion of the needle cylinder 11. The lower butt portions of the needles N-1 through N-4 are removably connected to the vertically reciprocating sleeve 12, by means of a snap lock ring 13.

The sleeve 12 is vertically reciprocated or successively raised and lowered by a yoke on one end of a horizontal arm 14, the other end of which is fixedly connected to the upper end of a vertically movable thrust rod 18. The lower end of the vertically movable thrust rod 18 is continuously raised and lowered by a reciprocating mechanism, not shown, rotated by the drive motor of the knitting machine, not shown. A vertical frame member or plate 20 is fixed at its lower end to the rear end of the lower horizontal frame member 10 and extends upwardly therefrom. The rear end portion of a horizontal support plate 21 is fixed to the rear support frame member 20 and extends forwardly therefrom.

The forward end of the support plate 21 supports an inlay yarn guide disk 22 for reciprocal movement around the upper end portion of the needle cylinder 11. The inlay yarn guide disk 22 is drivingly connected to a timing belt pulley 24 supported beneath the forward end of the support plate 21. The forward end portion of a timing belt 25 passes around and is drivingly connected to the timing belt pulley 24 and its rear end portion passes around an idler pulley 26 supported for reciprocation on the rear and lower portion of the support plate 21.

Alternating clockwise and counterclockwise reciprocations are imparted to the inlay yarn guide disk 22 by back-and-forth reciprocation of one leg of the timing belt 25. One leg of the timing belt 25 is moved back and forth by means of a slide block 30 fixed thereto and supported for back-and-forth sliding movement in a guide slot 31 of a guide plate 32. The guide plate 32 is fixed on one side of and extends below the support plate 21. The forward end of a crank arm 35 is fixed to the guide block 30 by means of a pivot screw 36 and the rear end of the crank arm 35 is connected to a rotating drive wheel 40 by means of a pivot screw 41. The pivot screw 41 is connected to the drive wheel 40 in eccentric relationship to the rotational axis thereof. The drive wheel 40 is continuously rotated in a counterclockwise direction through suitable drive means, not shown, connected to the drive motor. The inlay yarn guide disk 22 is provided with upstanding yarn guides 42 which are spaced in 90-degree relationship with each other and which are utilized for guiding the inlay yarns I-1 through I-4 to the needles of the knitting machine, in a manner to be presently described.

The rear end portion of a plate frame member 50 is fixed to the rear frame plate member 20 and extends forwardly therefrom with the forward end supporting the upper end portion of a base yarn guide sleeve 51 for clockwise and counterclockwise reciprocal movement. The base yarn guide sleeve 51 extends upwardly through the plate frame member 50 and has a timing gear pulley 52 drivingly connected thereto. The forward end of a timing belt 53 passes around and is drivingly connected to the timing belt pulley 52 and its rear end is supported on an idler pulley 54. Reciprocation is imparted to the timing belt 53 by means of a guide block 55. The guide block 55 is connected to one leg or run of the timing belt 53 and is guided for back-and-forth movement in a horizontal slot 56, formed in a guide plate 57, which is suitably supported along its lower edge portion on the frame plate member 50.

The guide block 55 is drivingly connected to the forward end of a crank arm 60 by means of a pivot screw 61. The rear end of the crank arm 60 is connected to a drive wheel 62 by means of a pivot screw 63. Continued counterclockwise rotation is imparted to the drive wheel 62 through drive connections, not shown, to the drive motor so that the crank arm 60 is moved back and forth, along with the timing belt 53, to impart successive clockwise and counterclockwise reciprocation to the timing belt pulley 52 and the base yarn guide sleeve 51, in a manner to be presently described.

The rear end portion of an upper frame plate member 70 is fixed on the upper end of the rear plate frame member 20 and extends forwardly therefrom. A yarn guide plate 71 is fixed on the forward end of the frame member 70 and extends forwardly thereof and is spaced above the timing belt pulley 53. An outer circular arrangement of spaced-apart yarn guide eyes is provided in the yarn guide 71 for directing the respective inlay yarns I-1 through I-4 downwardly and into the guide eyes on the upper ends of the inlay yarn guides 42. The inlay yarn I-3 extends downwardly from the guide plate 71 and through a slot, not shown, extending through the frame member 50.

An inner circle of yarn guide openings is provided in the yarn guide plate 71 for reception of the respective base yarns B-1 through B-4 and for directing the same downwardly and through vertical passageways and along the outer surface of the base yarn guide sleeve 51 to pass through yarn guide openings therein and to the needles, in a manner to be presently described. A central yarn guide opening 73 is provided in the yarn guide plate 71 so that a core yarn, indicated in dashdot lines at C in FIG. 3, can be directed therethrough and downwardly through the hollow center of the sleeve supporting the upper timing belt pulley 52 for reciprocation thereon. When the core C is incorporated in the circular warp knit composite cord, the core C also extends downwardly through the center of the needle cylinder 11 and the machine is provided with a suitable take-up mechanism, not shown, for withdrawing the circular warp knit composite cord as it is knit. The takeup mechanism also applies the desired amount of tension on the circular warp knit composite cord.

The timing belt drive arrangement for reciprocating the base yarn guide sleeve 51 and the inlay yarn guides 42 permits faster operating speeds for the knitting machine than have heretofore been possible. The driving of the timing belts 25, 53 by the corresponding crank arms 35, 60 also contributes to the increased operating speed of the circular warp knitting machine because the corresponding drive wheels 40, 62 impart the higher speed of movement to the timing belts 25, 53 during the medial portion of their reciprocating strokes and slow the movement of the timing belts 25, 53 as they approach the end portions of the stroke when they reverse directions. The timing belt drive arrangement also reduces the noise generated by the usual gear and pinion drive arrangements or a rack and pinion drive arrangement. For example, the present circular warp knitting machine illustrated in the drawings has been operated at speeds of approximately 4,000 courses per minute while conventional circular cylinder warp knitting machines commonly operate in the range of 800 to 1,200 courses per minute.

METHOD OF KNITTING

Figure 4:
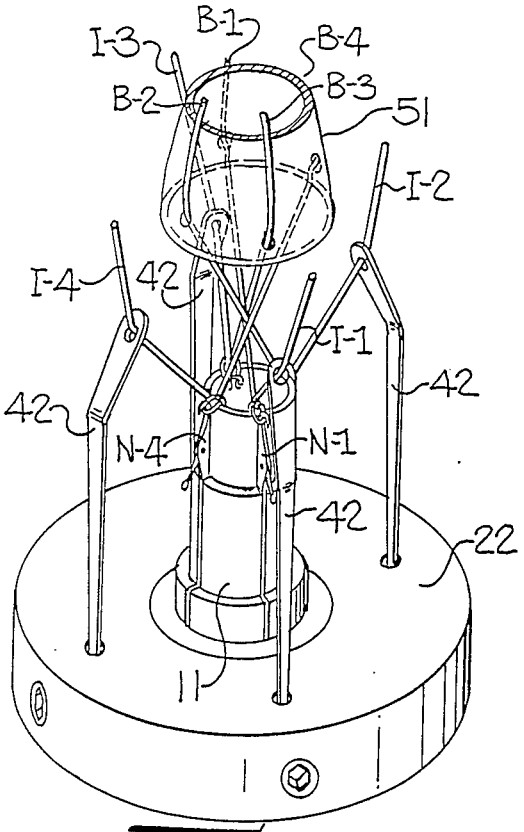
FIG. 4 is an enlarged fragmentary isometric view of the upper end portion of the needle cylinder and the adjacent yarn guide elements, illustrating the needles in the lowered stitch loop forming level.

The method of knitting the circular warp knit composite cord of FIG. 1 will be described in connection with the simultaneous longitudinal up and down movement of the needles N-1 through N-4 between the upper clearing level and the lower stitch loop forming level, as illustrated in FIGS. 4-7. Assuming that the needle loops have just been formed in the wales W-1 through W-4 of course C-1 and the needles N-1 through N-4 have been lowered to the stitch loop forming level, as shown in FIG. 4, the body yarn guide sleeve 51 will be nearing the end of its counterclockwise stroke, so that the base yarns B-1 through B-4 extend upwardly from the corresponding needles N-1 through N-4 and to a position slightly clockwise of the diametrically opposed needles. Also, the inlay yarn guides 42 have moved to the end of their clockwise reciprocation, substantially midway between the needles N-1 through N-4, and have started back in the counterclockwise direction so that they are substantially opposite the needles.

Figure 5:
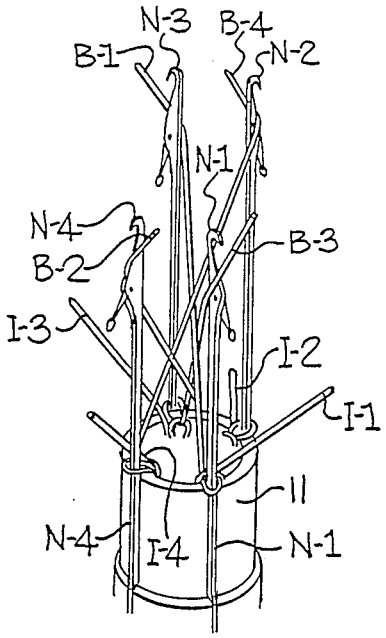
FIGS. 5–7 are isometric views illustrating the manner in which the base and inlaid yarns are guided to the needles as they are raised and lowered in the sequence of successive course formations.
Figure 6:
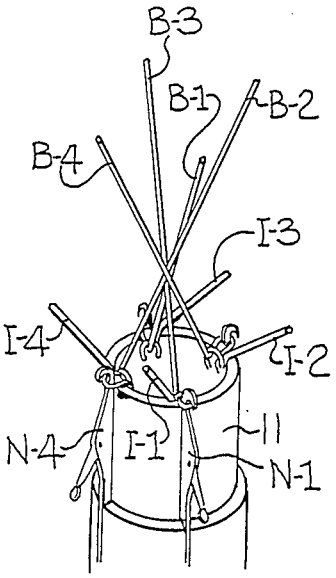

The needles N-1 through N-4 are then simultaneously raised to the clearing or shed level shown in FIG. 5 and the base yarn guide sleeve 51 rotates in a counterclockwise direction to wrap the yarns B-1 through B-4 around the corresponding needles so that they cross above the latches and under the hooks thereof, as shown in FIG. 5. At the same time, the inlay yarn guides 42 move to the end of their counterclockwise stroke with the yarns I-1 through I-4 extending upwardly at an angle from the corresponding needles N-1 through N-4. To knit the course C-2, the needles N-1 through N-4 are then drawn downwardly to the stitch loop forming level shown in FIG. 6 to form stitch loops in the wales diametrically opposed to the wales in which the stitch loops were formed in course C-1. As the needles are drawn downwardly to the stitch loop forming level of FIG. 6, the base yarn guide sleeve 51 reciprocates in a clockwise direction so that the base yarns B-1 through B-4 are positioned above and slightly counterclockwise of the diametrically opposed needles. At the same time, the inlay yarn guides 42 move to the end of their clockwise stroke with the yarns I-1 through I-4 extending upwardly at an angle from the corresponding needles N-1 through N-4.

Figure 7:
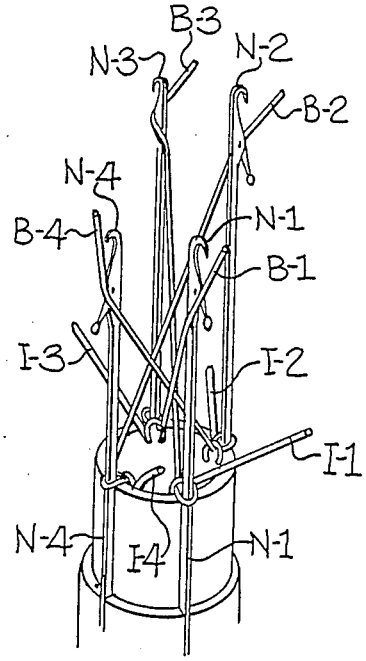

The needles N-1 through N-4 are then simultaneously raised to the clearing or shed level, as shown in FIG. 7, and the base yarn guide sleeve 51 is moved clockwise so that the base yarns B-1 through B-4 are wrapped across the needles above the latches and beneath the hooks, as illustrated in FIG. 7. At the same time, the inlay yarn guides 42 move to the end of their counterclockwise stroke with the yarns I-1 through I-4 extending upwardly at an angle from the corresponding needles N-1 through N-4. The needles are then lowered to form stitch loops in the course C-3. Thus, the body yarn B-1 which formed a stitch loop in wale W-1 of course C-1 next forms a stitch loop in wale W-3 of course C-2 and then forms a needle loop in wale W-1 of course C-3. This sequence of knitting then continues to form the circular warp knit composite cord illustrated in FIG. 1 of any desired length. As described, all of the needles N-1 through N-4 are simultaneously raised and lowered during the knitting process. Although the upper ends of the needles N-2 and N-3 are illustrated in FIGS. 5 and 7 at a higher level than the needles N-1 and N-4, for providing a clearer view of the upper ends of the needles N-2 and N-3, all needles are raised to the same level by means of the vertically reciprocating sleeve 12.

The same knitting sequence is carried out to form the circular warp knit composite cord with the core member C as illustrated in FIG. 2 and the laps between the diametrically opposed stitch loops in adjacent courses are wrapped about the core C. The laps tightly engage and grip the core C and prevent slippage of the warp knit tube thereon.

The method of knitting described and illustrated in FIG. 1 may be termed alternate wale knitting in which the base yarn guide sleeve 51 is reciprocated slightly over 180° each time that the needles are raised so that stitch loops are formed on opposite sides of the warp knit tube in successive courses. However, it is to be understood that needle loops in successive courses could be formed on adjacent needles or wales and the base yarn guide sleeve 51 would then be reciprocated slightly over 90° in opposite directions. Also, the needle loops in adjacent courses could be spaced apart a greater distance than one needle or wale. In the case of a four wale circular warp knit tube, the base yarn guide sleeve 51 would then be reciprocated slightly over 270° in each direction.

The circular warp knit composite cord of the present invention provides a new product not heretofore available, and one which may be useful in many different types of end uses. The provision of the inlay yarns interlaced in selected wales of the base yarn needle loops markedly alters the physical characteristics of the resultant warp knit tube. By varying the metered feed rate and tension of the inlay yarns relative to that of the knit yarns, it is possible to regulate the stretch modulus and stability of the resultant warp knit composite tube. Through selective choice of the type of inlay yarns it is also possible to construct composite warp knit tubes which can serve as: (a) electric and fiber optic conductors; (b) "serving" for difficult-to-handle yarns such as alumina, ceramics, and carbon; (c) liquid and gas carrying hoses; (d) woven, knit, and wound filtration fabrics; (e) paper maker felt fabrics and hinge pintles; (f) common rope and utility cords; (g) decorative cords and yarns; and (h) similar useful, industrial products. Positive feed yarn metering also insures that the same type of composite cord is knit on the machine each time that the machine is set up to produce a particular type of composite cord.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A circular warp knit composite cord comprising a circular warp knit tube including a plurality of wales of base yarn needle loops circumferentially spaced around said tube, the base yarns forming the wales of needle loops also forming laps extending between and interconnecting said circumferentially spaced wales of base yarn needle loops, and inlaid yarns interlaced in selected ones of said wales of base yarn needle loops and extending therealong to control longitudinal stretchability of said circular warp knit tube.

2. A circular warp knit composite cord according to claim 1 wherein said inlaid yarns are interlaced in each of said plurality of wales of base yarn needle loops.

3. A circular warp knit composite cord according to claim 1 including an inner core element extending longitudinally and inside of said circumferentially spaced wales of base yarn needle loops.

4. A circular warp knit composite cord according to claim 1 wherein said base yarns form wales of needle loops in successive courses and wherein a base yarn forming a needle loop wale in one course then forms a needle loop in a wale circumferentially spaced from said given wale in the subsequent course.

* * * * *